US011415296B1

(12) United States Patent
Chen

(10) Patent No.: US 11,415,296 B1
(45) Date of Patent: Aug. 16, 2022

(54) LED MODULE ARRAY SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/373,862

(22) Filed: Jul. 13, 2021

(51) Int. Cl.

| | |
|---|---|
| ***F21V 21/005*** | (2006.01) |
| ***F21V 21/24*** | (2006.01) |
| ***F21V 21/08*** | (2006.01) |
| ***F21Y 115/10*** | (2016.01) |

(52) U.S. Cl.
CPC ..... *F21V 21/005* (2013.01); *F21V 21/0832* (2013.01); *F21V 21/24* (2013.01); *F21Y 2115/10* (2016.08)

(58) Field of Classification Search
CPC ..... F21V 21/00–008; F21V 21/14–32; F21V 23/00–06; F21Y 2115/10
See application file for complete search history.

(56) References Cited

U.S. PATENT DOCUMENTS 4,707,766 A * 11/1987 Bertozzi ..... F21S 2/005 362/11
9,836,999 B2 * 12/2017 Nall ..... F21V 29/507
10,446,065 B2 * 10/2019 Quaal ..... G09F 13/04

* cited by examiner

*Primary Examiner* — Jason M Han
(74) *Attorney, Agent, or Firm* — Stuart M. Goldstein

(57) ABSTRACT

An LED module array system has a plurality of individual array modules which have bar connectors extending from their top edges and hook connectors extending from their bottom edges. The bar connectors and hook connectors are configured to be conjoined so as to position the array modules in spaced relation to each other to form rows. Bottom supports are provided which are adjustable in order to maintain different lengths of the array system in stable positions. A single positive/negative electrical wire extends through each array module to a quick electrical connector attached to one of the electrical wires and also to an electrical power source for transmitting electricity from the power source for illuminating the LED lamps on each of the array modules in the modular array system.

4 Claims, 7 Drawing Sheets

LED MODULE ARRAY SYSTEM

FIELD OF THE INVENTION

The present invention relates generally to LED modules and particularly to LED modules within an LED module array system.

BACKGROUND OF THE INVENTION

Modules with LED lamps are commonly used for a variety of applications, especially in lighted signage. There are innumerable different configurations of LED modules which are incorporated into signage, depending on desired appearance and signage requirements. For example, the vertical placement of modules is often utilized in signage applications. However, there are no LED modules which are particularly equipped to be adjustably aligned vertically and horizontally, but also have the flexibility and versatility to be connected and disconnected quickly and simply in order to alter different design and size configurations which make up module array systems.

SUMMARY OF THE INVENTION

It is thus the object of the present invention to provide a module array system comprising individual array modules having array module connectors which provide for snap-on attachment between array modules, in order to form module array systems which consist of array modules aligned in spaced relation to each other.

These and other objects are accomplished by the present invention, an LED module array system comprising a plurality of individual array modules which have bar connectors extending from their top edges and hook connectors extending from their bottom edges. The bar connectors and hook connectors are configured to be conjoined so as to position the array modules in spaced relation to each other to form rows. Bottom supports are provided which are adjustable in order to maintain different lengths of the array system in stable positions. A single positive/negative electrical wire extends through each array module to a quick electrical connector attached to one of the electrical wires and also to an electrical power source for transmitting electricity from the power source for illuminating the LED lamps on each of the array modules in the module array system.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
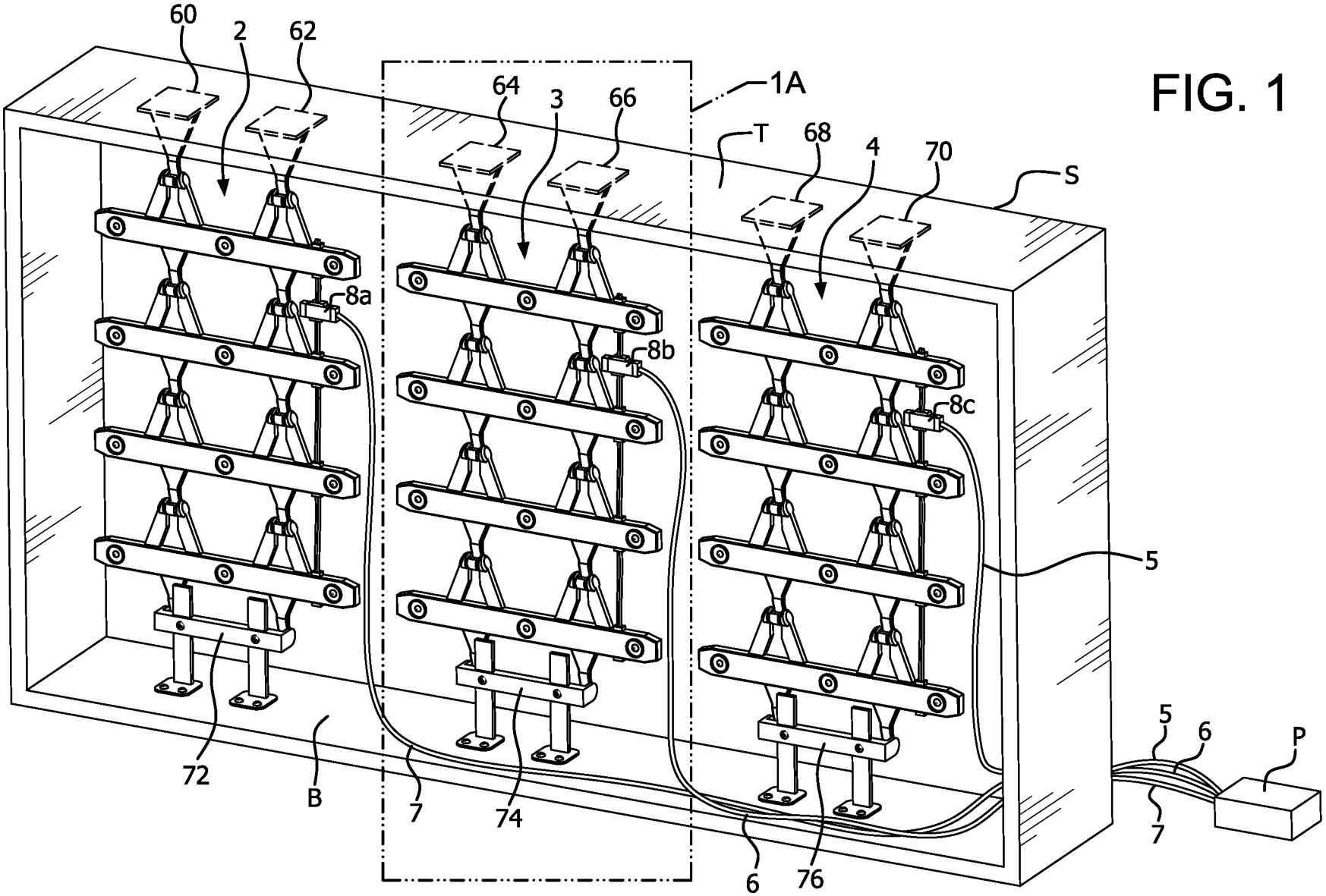
FIG. 1 shows an exemplar lighted signage box comprising three separate LED module array systems.

The module array system of the present invention comprises a series of LED array modules configured to be aligned in spaced relation and hung vertically. FIG. 1 illustrates one example of the manner in which module array systems 2, 3, and 4, can be positioned within lighted signage box S.

Figure 2:
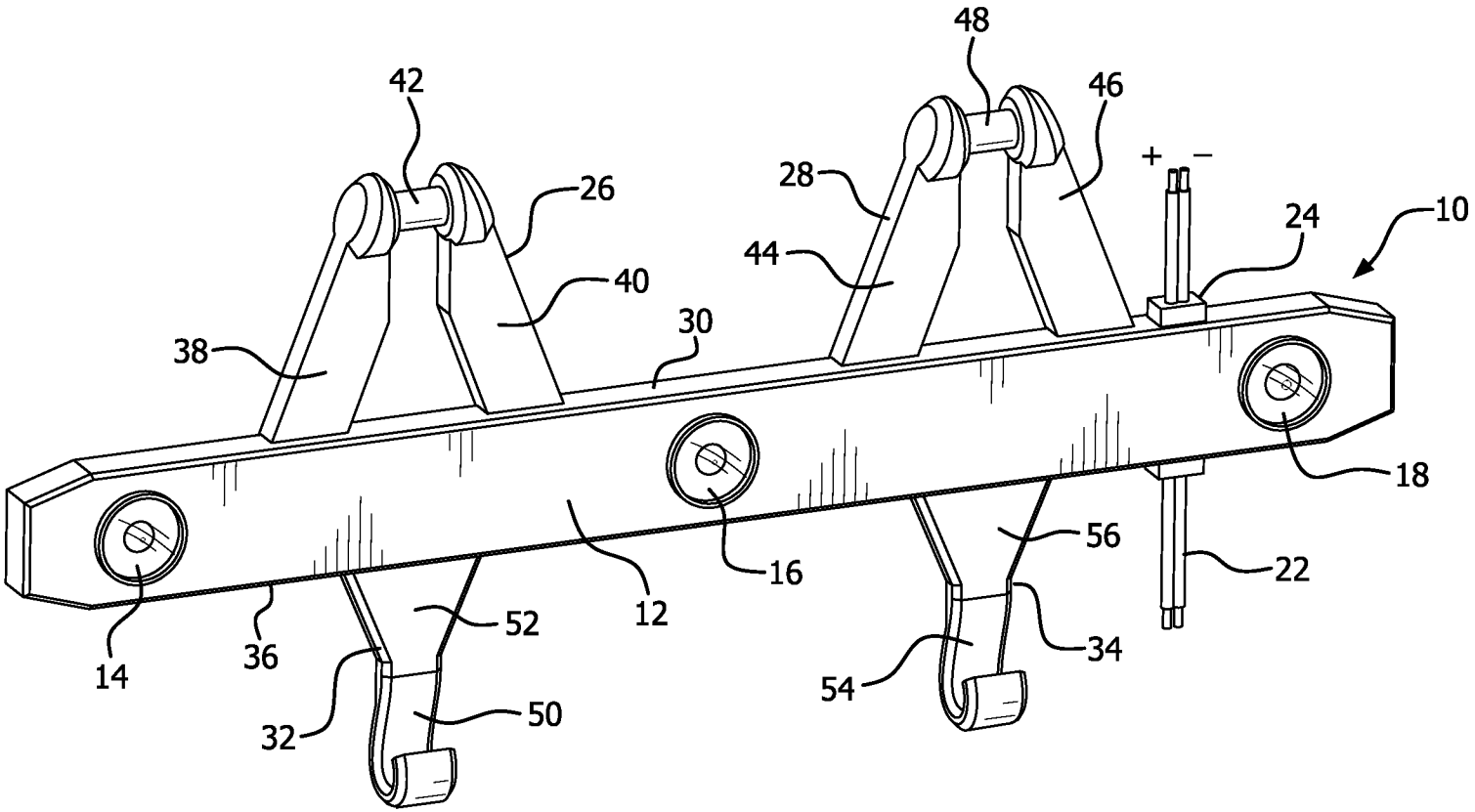
FIG. 2 is a perspective front view of an LED array module of the present invention.
Figure 3:
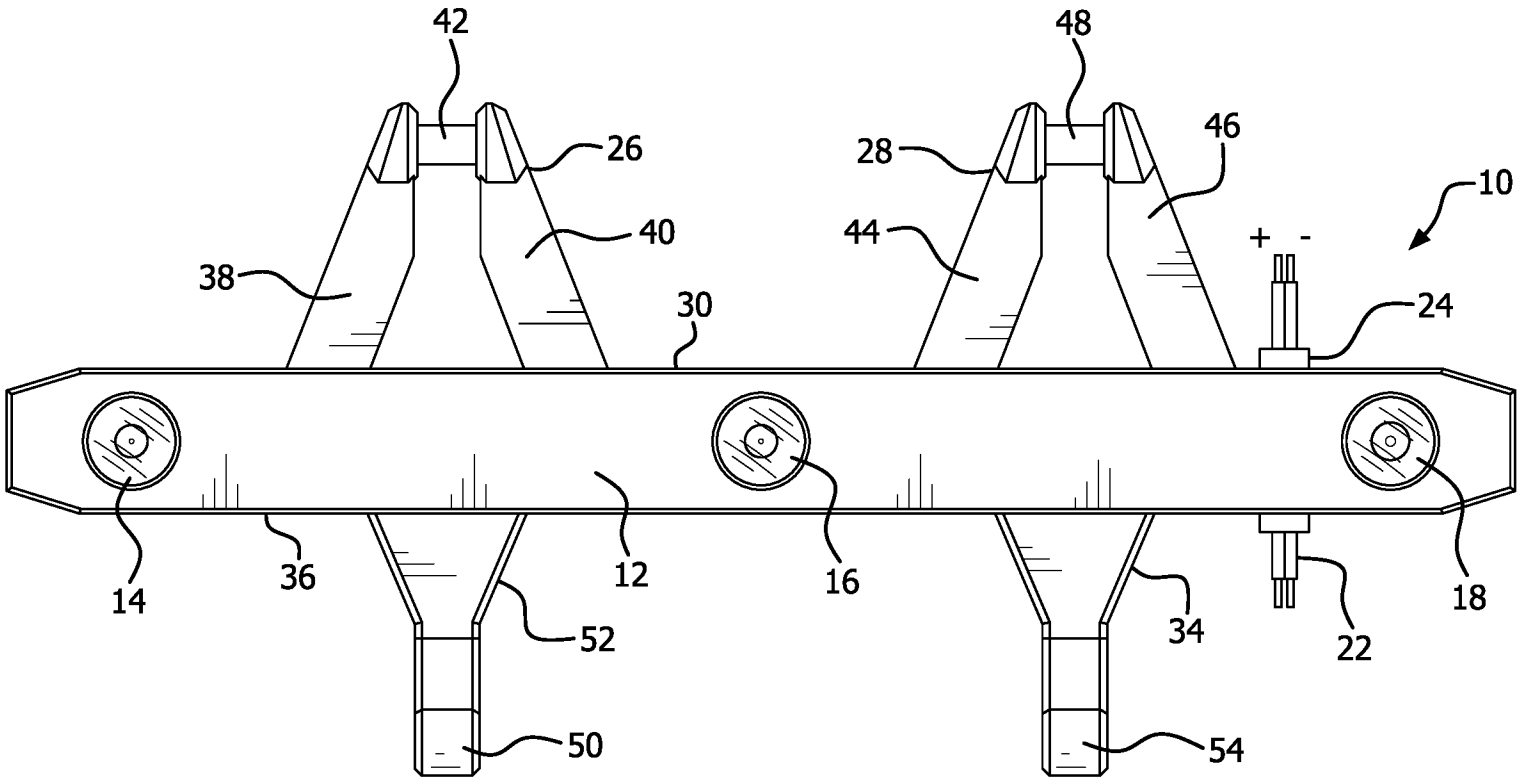
FIG. 3 is a front view of an LED array module of the present invention.
Figure 4:
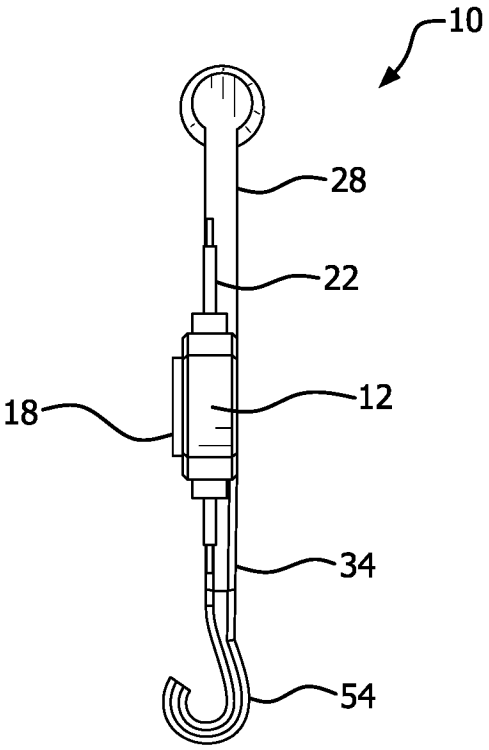
FIG. 4 is an elevation view of an LED array module of the present invention.

With specific reference to FIGS. 2-4, LED array module 10 comprises module body 12 having LED lamps 14, 16, and 18. A single positive/negative electric wire 22 extends into and through module body 12 via electrical connection 24 for attachment with electric module circuitry located within the module body to ultimately illuminate lamps 14, 16, and 18 from electrical power source P.

Array module connection means comprises array module connectors 26 and 28 which extend from top edge 30 of module body 12 and complementary array module connectors 32 and 34 extending from bottom edge 36 of the module body.

Array module connector 26 is a bar connector having dual arms 38 and 40 and intermediate support bar 42 and array module connector 28 is a bar connector having dual arms 44 and 46 and intermediate support bar 48. Array module connector 32 is a hook connector having hook 50 extending from support arm 52 and array module connector 34 is a hook connector having hook 54 extending from support arm 56.

Figure 1A:
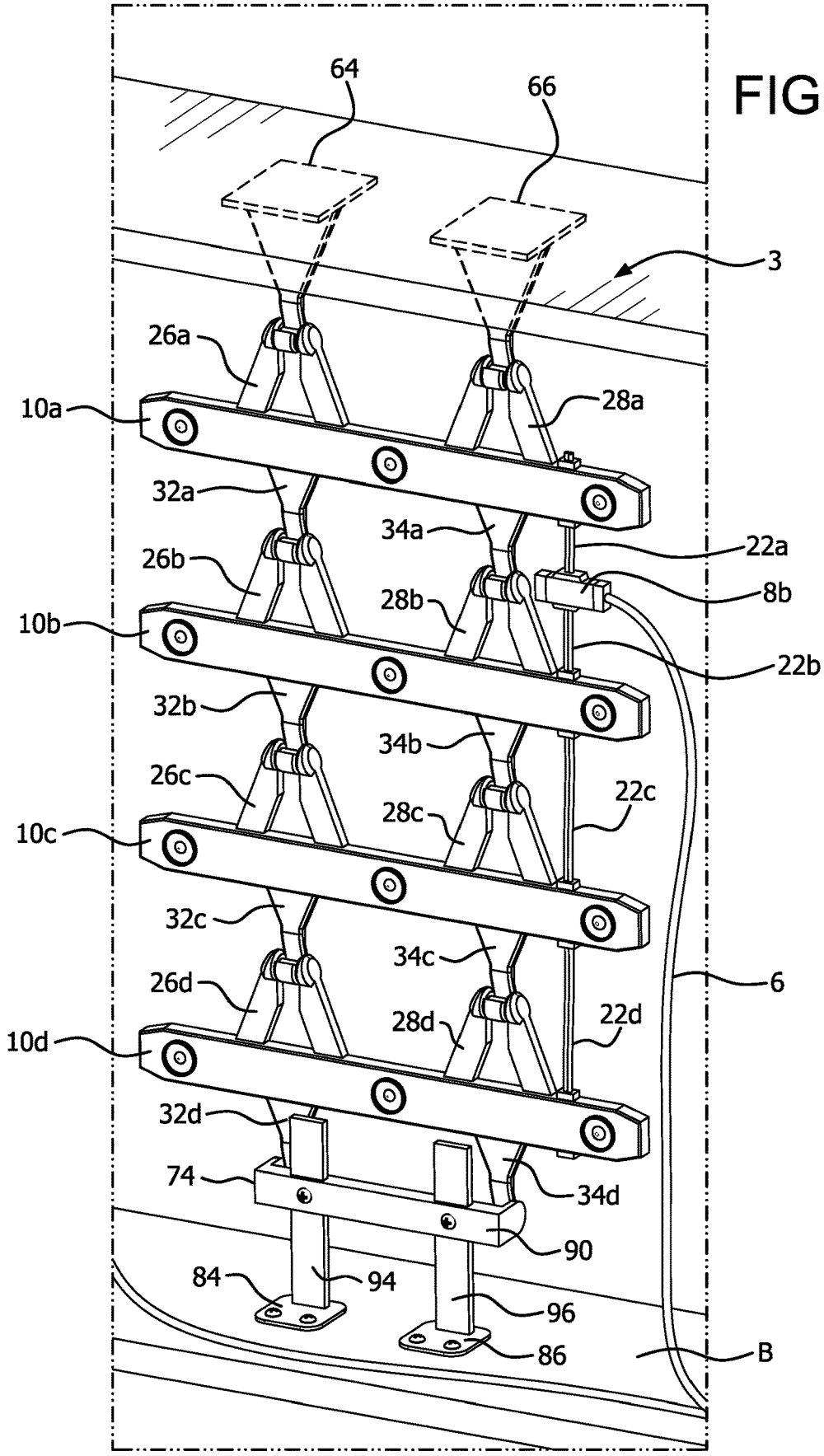
FIG. 1A is an exploded view of a single LED module array system, taken from FIG. 1.

Referring to FIG. 1 and FIG. 1A, module array systems 2, 3, and 4 each comprise four array modules suspended vertically, in spaced relation to each other. For the sake of simplicity of disclosure, the various components which comprise the module array system of the present invention are described herein with reference to FIG. 1A, showing module array system 3. It should be understood that module array systems 2 and 4 have the identical components.

Module array system 3 comprises array modules 10*a*, 10*b*, 10*c*, and 10*d*. Array module 10*a* has array module connectors 26*a*, 28*a*, 32*a*, and 34*a*; array module 10*b* has array module connectors 26*b*, 28*b*, 32*b*, and 34*b*; array module 10*c* has array module connectors 26*c*, 28*c*, 32*c*, and 34*c*; and array module 10*d* has array module connectors 26*d*, 28*d*, 32*d*, and 34*d*.

A significant feature of the present invention is the manner in which the array module connectors of the array modules are conjoined to each other, in spaced relation, to form a module array system. For example, the hooks on array module connectors 32*a* and 34*a* of array module 10*a* are configured to snap onto the support bars of array module connectors 26*b* and 28*b* of array module 10*b*, thereby conjoining the two array modules in spaced relation, one array module below the other. The array module connectors of modules 10*c* and 10*d* are similarly connected to form suspended module array system 3.

Module array system 2 is suspended from top T of signage box S via supports 60 and 62; module array system 3 is suspended from the top of storage box S by supports 64 and 66; and module array system 4 is suspended from the top of signage box S by supports 68 and 70. Module array systems 2, 3, and 4 are held in place and prevented from shifting at bottom B of signage box S by lower supports 72, 74, and 76.

Figure 5:
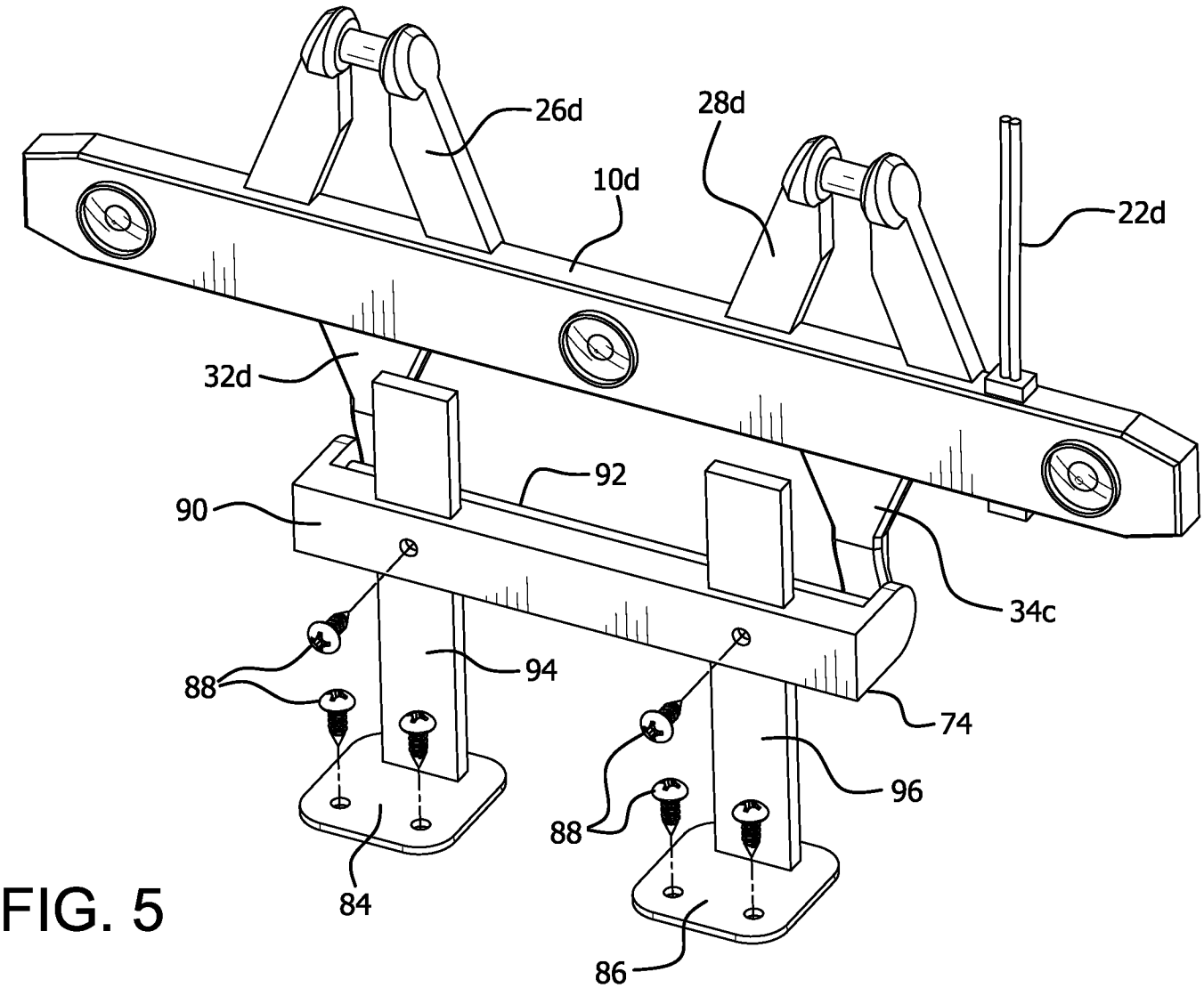
FIG. 5 is a perspective front view of a bottom support of the LED module array system of the present invention, with an array module aligned for attachment to the bottom support.
Figure 6:
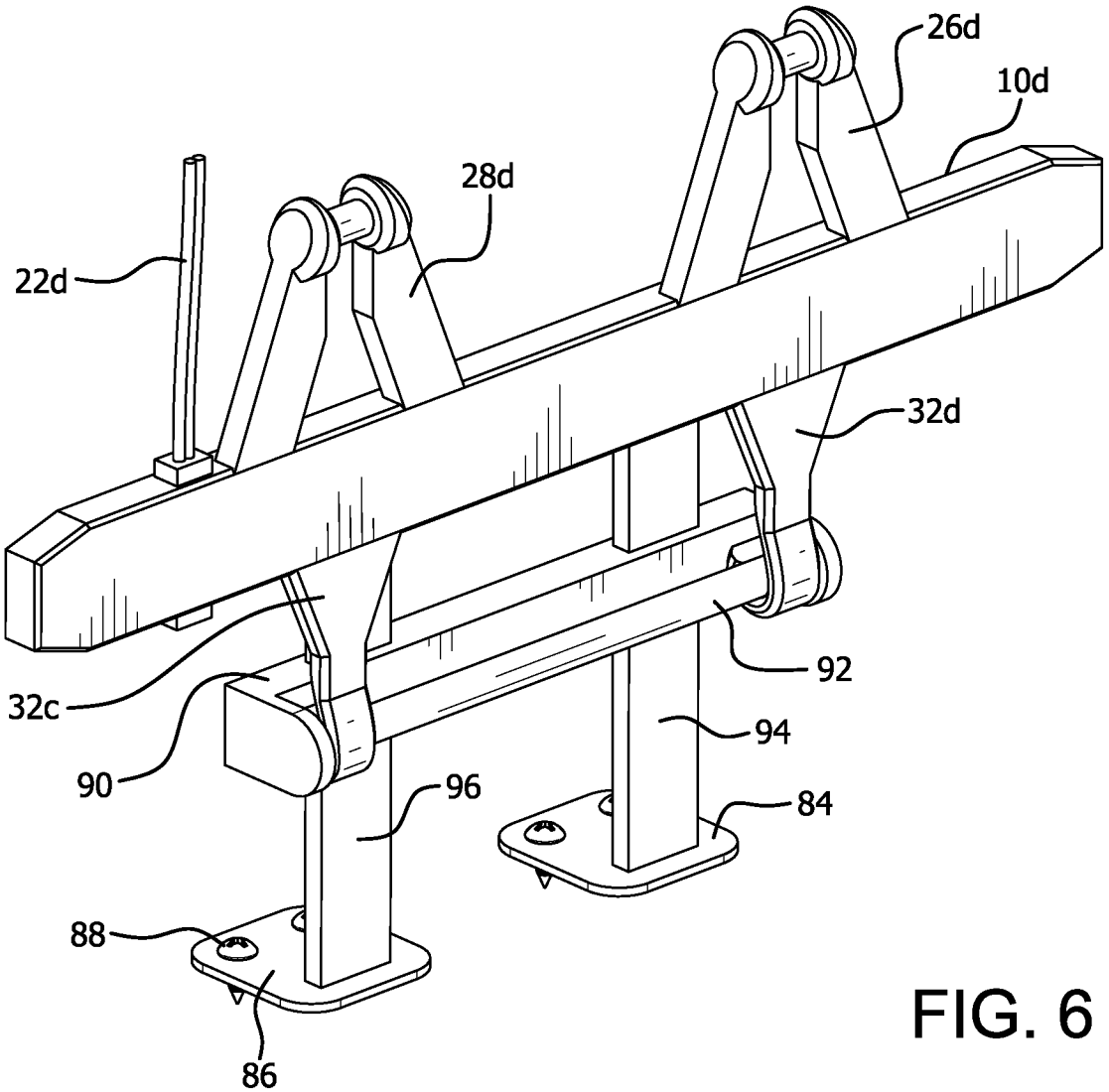
FIG. 6 is a perspective rear view of the bottom support of the LED module array system of the present invention, with an array module conjoined with the bottom support.

With reference to FIGS. 5 and 6, bottom support 74 is shown in detail. It is understood that bottom supports 72 and 76 are identical to bottom support 74. Base members 84 and 86 are secured to bottom B of signage box S by screws or equivalent attachments 88. Bottom bracket 90 having bracket bar 92, is slidably mounted on support posts 94 and 96. The hooks of array module connectors 32*d* and 34*d* are positioned over bracket bar 92 and bottom bracket 90 is slid along support posts 94 and 96, such that it reaches the location on the posts where module array system 3 is maintained in stable position, sufficient to prevent it from shifting. Screws 88 secure bottom bracket 90 to support posts 94 and 96, to ensure that the bottom bracket is fixed at this location on the support posts.

Electrical power is provided to the module array systems by electrical power source P. Electrical wiring 5, 6 and 7 extends from power source P to quick electrical connectors 8*a*, 8*b*, and 8*c*. Quick electrical connector 8*b* is also attached to positive and negative electric wire 22*a* and 22*b* and quick electrical connectors 8*a* and 8*c* are also attached to the positive and negative electric wires which extend from the array modules which make up module array systems 2 and 4. Electricity from power source P is thus transmitted via electrical wiring 5, 6, and 7, through connectors 8*a*, 8*b*, and 8*c*, to illuminate the array modules in the three array module systems 2, 3, and 4 shown in FIG. 1.

While FIG. 1 discloses the use of four array modules in each module array system, it is contemplated that up to seventy-five (75) array modules can be utilized in any one array module system. In such cases, the signage boxes will obviously need to be modified to accommodate the different sizes of the vertically extending array module systems. While the herein disclosure describes vertically mounted module array systems, it is contemplated that these array systems could also be mounted in horizontal positions.

Thus, by the present invention, LED array modules can be snapped together and interconnected to form LED module array systems of varying lengths. Given the versatility provided by the ease of interchangeability of the array module connectors of the array modules, the lengths and configurations of the module array systems can be changed at the desire of the user based on need for specific appearance and utility.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An electric array module for inclusion in an electric module array system, said array module comprising:

a module body having a plurality of LED lamps, said module body having a top edge and a bottom edge, two upper array module connectors, each of said upper array module connectors having a pair of arm members extending upwardly from the top edge of the module body and a support bar extending between and connecting upper ends of the arm members, two complementary lower array module connectors, each of said lower array module connectors having a support arm extending down from the bottom edge of the module body and a hook extending down from the lower end of each of the support arms, wherein the hooks of the support arms are configured to be positioned beneath and be conjoined with the support bars of upper module connectors of a second electrical array module hung below and in spaced relation to the array module, and an electrical wire input connection for receiving a single, positive/negative electrical wire which extends through the module body and which provides electricity to the array module from an electrical power source for illuminating the LED lamps.

2. An electric module array system comprising:

a first array module comprising a module body having a plurality of LED lamps, said module body having a top edge and a bottom edge, two upper array module connectors, each of said upper array module connectors having a pair of arm members extending upwardly from the top edge of the module body, and a support bar extending between and connecting upper ends of the arm members and two complementary lower array module connectors, each of said lower array module connectors having a support arm extending from the bottom edge of the module body and a hook extending down from the lower end of each of the support arms, and an electrical wire input connection for receiving a first, positive/negative electrical wire which extends through the module body and which provides electricity to the array module from an electrical power source for illuminating the LED lamps;

a second array module comprising a module body having a plurality of LED lamps, said module body having a top edge and a bottom edge, two upper array module connectors, each of said upper array module connectors having a pair of arm members extending upwardly from the top edge of the module body, and a support bar extending between and connecting upper ends of the arm members and two complementary lower array module connectors, each of said lower array module connectors having a support arm extending from the bottom edge of the module body and a hook extending down from the lower end of each of the support arms, and an electrical wire input connection for receiving a second, positive/negative electrical wire which extends through the module body of the second array module and which provides electricity to the second array module from the power source for illuminating the LED lamps, wherein the hooks of the support arms of the first array module are configured to be positioned beneath and be conjoined with the support bars of the second array module such that the second array module is hung below and in spaced relation to the first array module;

a quick electrical connection member which connects the first electric wire extending through the first array module the second electric wire extending through the second array module, and a single electrical wire connected to the connection member for providing electricity from the power source through the single electrical wire to the connection member for illuminating the LED lamps of the first and second array modules.

3. The electric module array system as in claim 2 further comprising additional array modules each having a plurality of LED lamps, a modular body having a top edge and a bottom edge, two upper array module connectors extending upwardly from the top edge, two complementary lower array module connectors extending from the bottom edge and a hook extending down from the lower end of each of the support arms, and an electrical wire input connection for receiving a single, positive/negative electrical wire which extends through the module body of each array module, wherein the additional array modules are conjoined and positioned, one in spaced relation beneath the other, to form a row of aligned array modules which are all illuminated by the power source.

4. The electric module array system as in claim 3 further comprising a bottom support comprising a bottom bracket having a bracket bar, wherein the at least one array module connector extending from the bottom edge of the lowermost array module in the module array system is conjoined with the bracket bar to maintain the module array system in a stable position.

* * * * *